US007730696B2

(12) United States Patent
Reynolds

(10) Patent No.: US 7,730,696 B2
(45) Date of Patent: Jun. 8, 2010

(54) METHOD OF MAKING A STONE WALL

(76) Inventor: Scott Reynolds, 2508 Cedar Hills Dr., Minnetonka, MN (US) 55305

( * ) Notice: Subject to any disclaimer, the term of this patent is extended or adjusted under 35 U.S.C. 154(b) by 1037 days.

(21) Appl. No.: 11/135,009

(22) Filed: May 23, 2005

(65) Prior Publication Data

US 2006/0260264 A1 Nov. 23, 2006

(51) Int. Cl.
*E04B 2/00* (2006.01)

(52) U.S. Cl. ..... 52/747.12; 52/745.1; 52/745.2; 52/105; 206/322

(58) Field of Classification Search ..... 52/105, 52/747.1, 747.11, 747.12, 745.1, 745.2, 311.2; 434/74, 80, 82; 703/1, 6; 206/322
See application file for complete search history.

(56) References Cited

U.S. PATENT DOCUMENTS 2,474,654 A * 6/1949 Carlson ..... 264/226
3,477,184 A * 11/1969 Siivola et al. ..... 52/105
4,573,295 A * 3/1986 Wilkinson ..... 52/105
5,713,561 A * 2/1998 Sugiyama ..... 256/19
7,100,341 B2 * 9/2006 McIlvaine ..... 52/745.2
7,318,299 B2 * 1/2008 Chambers ..... 52/105
2006/0085268 A1 * 4/2006 Imendorf et al. ..... 705/16

* cited by examiner

*Primary Examiner*—Robert J Canfield
(74) *Attorney, Agent, or Firm*—Schwegman Lundberg & Woessner, P.A.

(57) ABSTRACT

The invention described herein includes a method embodiment for making a stone wall manufacturing kit. The method embodiment includes providing a plurality of stones having a variety of thicknesses and lengths; sorting the stones based upon length and thickness of each of the stones; preparing an image of the stone wall; marking each stone within the image with an identifier to make a marked stone image; marking each stone of the plurality of stones with an identifier corresponding to the identifier of the stone in the image of the assembled stone wall; and packaging the marked stones and marked stone image to make a stone wall kit.

6 Claims, 25 Drawing Sheets

SHAPE #6

SHAPE #7

SHAPE #8

SHAPE #9

SUPER-SHAPE #10

SUPER-SHAPE #11

SUPER-SHAPE #12

SUPER-SHAPE #13

METHOD OF MAKING A STONE WALL

FIELD

Embodiments of the invention described herein relate to kit and method embodiments of making stone wall embodiments and stone walkway, patio and floor embodiments and a sorter for sorting stones.

COPYRIGHT

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever. The following notice applies to any software and data as described below and in the drawings that form a part of this document: Copyright 2005, Creative Habitats Inc. All Rights Reserved.

BACKGROUND

Stone walkways, patios, walls, stone floors and other stone constructions have been made for thousands of years in much the same difficult and time consuming process. The process has required significant training on the part of craftsmen making the walkways, patios, floors and walls. The craftsmen have had to procure a collection of stones, typically quarried stones, which have been purchased on a weight basis. The craftsmen then have had to seek and find particular stones acquired in the purchase, in a time-consuming step. Frequently, the craftsmen have had to cut the stones for proper fitting, resulting in problems of waste stone products and disposal of the waste stone. The cutting also generated unhealthy dust particles, small stone pieces and flying debris. Also, the patios, walkways, flooring, and other stone constructions had inconsistent gaps, as shown in prior art FIG. 10. In some instances, the gaps were filled in with small asymmetric stones that detracted from the aesthetics of the stone construction. The small stones also tended to become separated from the walkway, creating a safety hazard.

SUMMARY

The invention described herein includes a method embodiment for making a stone wall manufacturing kit. The method embodiment includes providing a plurality of stones having a variety of thicknesses and lengths; sorting the stones based upon length and thickness of each of the stones; preparing an image of the stone wall; marking each stone within the image with an identifier to make a marked stone image; marking each stone of the plurality of stones with an identifier corresponding to the identifier of the stone in the image of the assembled stone wall; and packaging the marked stones and marked stone image to make a stone wall kit.

Another embodiment includes computer readable media for making a stone wall manufacturing kit that includes marked stones and an image of an assembled wall. The method includes means for determining length and height for each stone in the stone wall made by the kit.

Another embodiment includes a stone wall kit. The stone wall kit includes a plurality of stones, each stone having an identifier, and an image of a stone wall comprising images of the stones wherein the image of each of the stones includes an identifier that is associated with the identifier of the stone.

Another embodiment includes a stone patio kit. The stone patio kit includes a plurality of stones, each stone having a shape in conformance with a predetermined plurality of standard shapes; and an image of a patio, comprising images of stones from the plurality.

Another embodiment includes a stone sorter that includes a conveyer and a marker for marking stone height.

IN THE FIGURES

FIG. 7 also illustrates sorted stones.

FIG. 6 illustrates an image of a wall made by a method embodiment schematically shown in FIG. 1.

Figure 30:
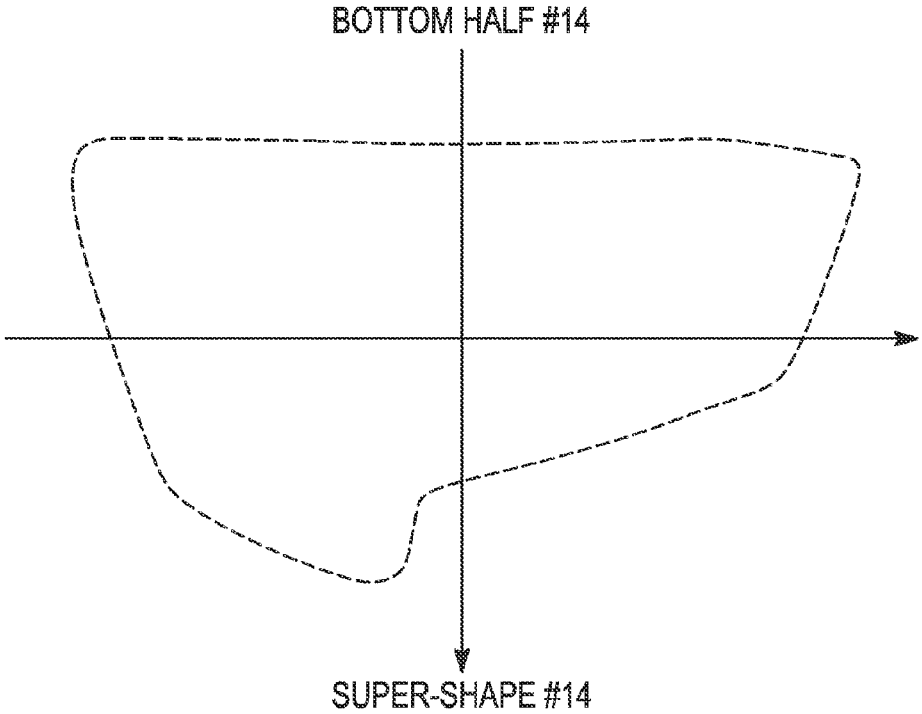
Figure 31:
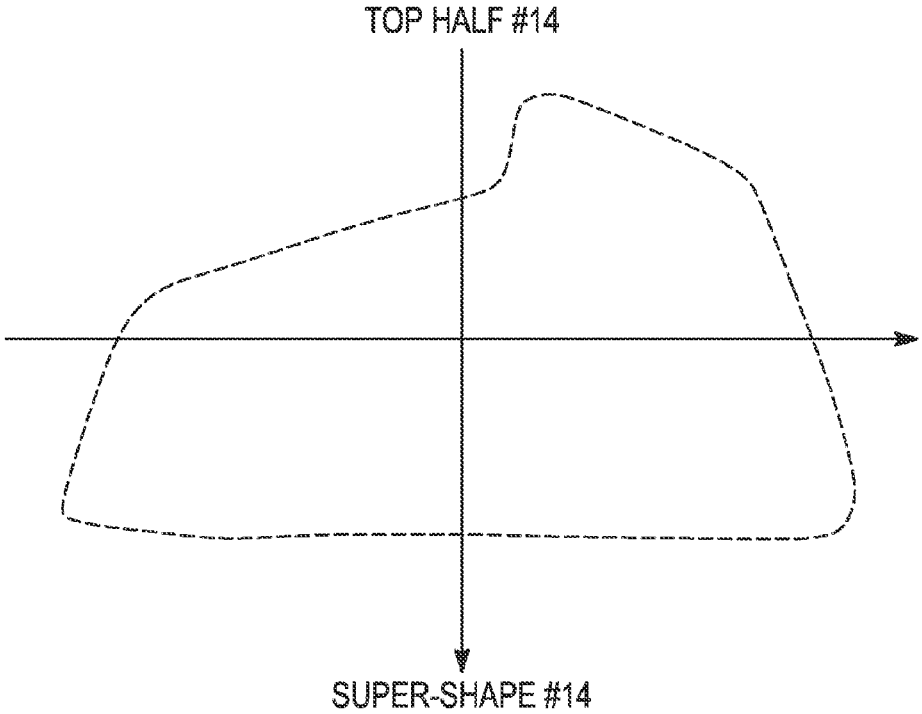

FIGS. 30 and 31 illustrate a super-shape made by either placing four stones having shape No. 7 adjacent to each other or by placing two stones having super-shape 13 adjacent to each other or some other combination of stones with shape No. 7 and shape No. 13. This super-shape has a designation of shape No. 14. FIG. 30 illustrates a bottom portion of the super-shape and FIG. 31 illustrates a top portion.

DESCRIPTION

Methods, apparatus and systems for a variety of embodiments are described herein. In the following description, numerous specific details are set forth. However, it is understood that embodiments of the invention may be practiced without these specific details. In other instances, well-known circuits, processes, structures, and techniques have not been shown in detail in order to avoid obscuring the understanding of this description. Note that in the description, references to "one embodiment" or "an embodiment" mean that the feature being referred to is included in at least one embodiment of the invention. Further, separate references to "one embodiment" in this description do not necessarily refer to the same embodiment; however, neither such embodiments are mutually exclusive, unless so stated and except as will be readily apparent to those of ordinary skill in the art. Thus, the invention described herein may include any variety of combinations and/or integrations of the embodiments described herein. Moreover, in this description, the phrase "exemplary embodiment" means that the embodiment being referred to serves as an example or illustration.

As used herein, the term "stone" or "stone fraction" refers to material that includes an aggregate of minerals such as those making up the Earth's crust. For some embodiments the stone or stone fraction is hewn in a particular shape for a particular purpose.

Embodiments described herein include a kit for making a stone wall, a method for making the kit for making a stone wall; and a method for making the stone wall from the kit; a kit for making a stone patio or stone walkway and method embodiments for making and using the kit for making a stone patio or a stone walkway; and a sorting table for sorting stones used in the kit for making a stone wall.

Figure 3:
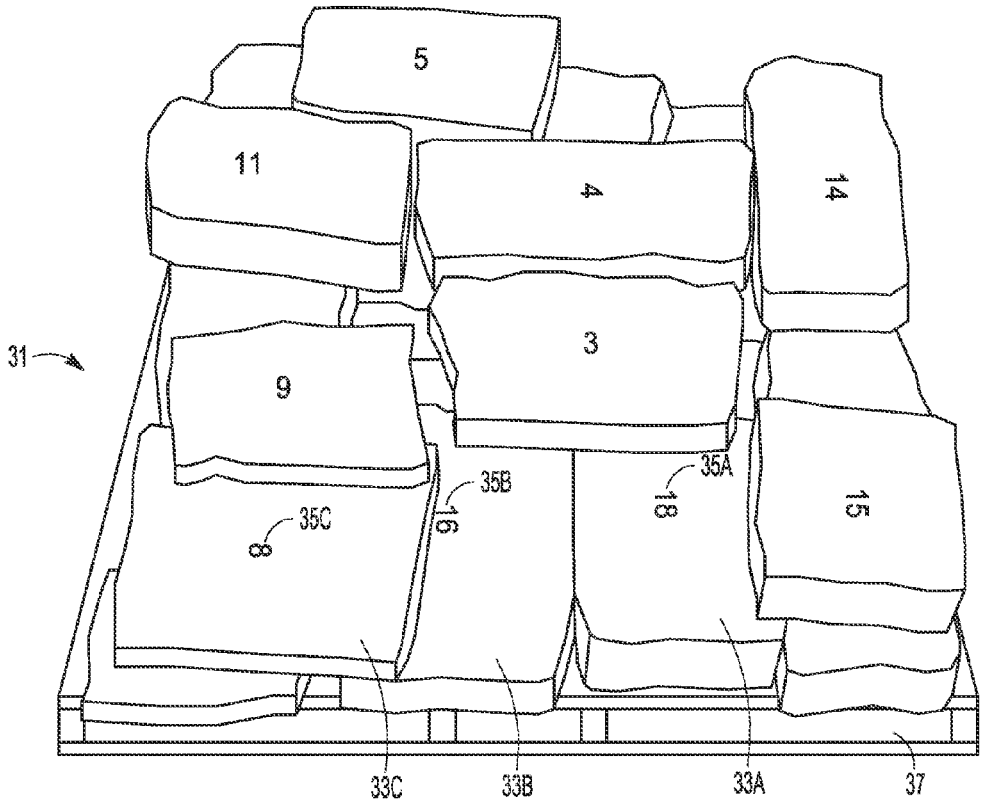
FIG. 3 illustrates a perspective view of a kit embodiment for making a stone wall.
Figure 4:
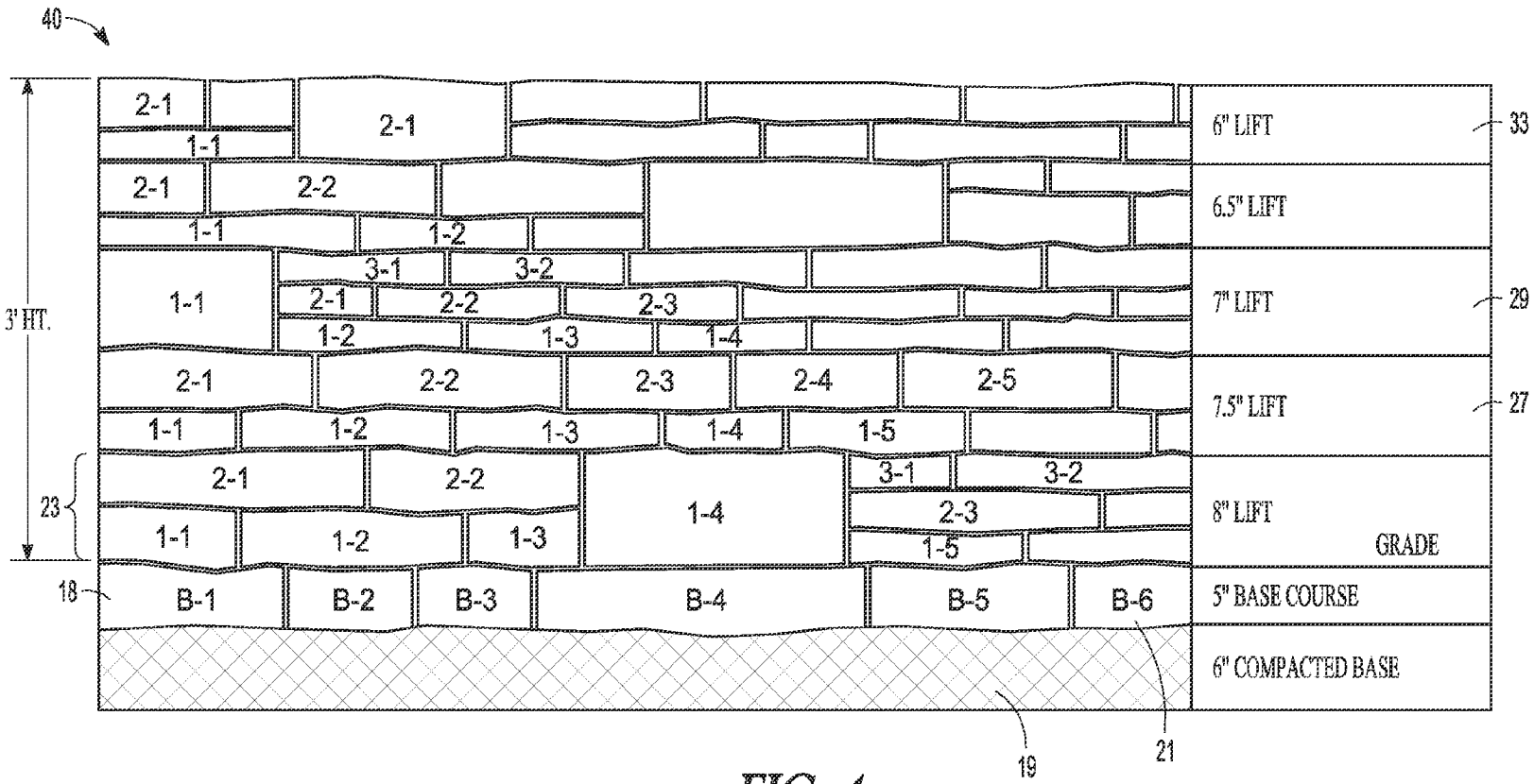
FIGS. 4 and 6 illustrate an image of a wall made by a method embodiment schematically shown in FIG. 1 wherein the stone images in the wall image are numbered.

One kit embodiment for making a stone wall, illustrated generally at 31 in FIG. 3, includes a plurality of stones 33A, 33B, and 33C, each stone including a tag 35A, 35B and 35C that identifies the location of the stone in the stone wall, a pallet 37 or other device for transporting the stones, and an image of the stone wall, illustrated at 40 in FIG. 4, that is to be made with the stones, wherein the image 40 illustrates the location of the stones in the wall, such as is shown in the FIG. 4. In particular, the image shown at 40 in FIG. 4 illustrates images of numbered stone fractions 18 corresponding to actual stone fractions, and their position in the stone wall. For some embodiments, the kit for making a stone wall also includes one or more pallets, shown at 37 in FIG. 3 for storing and transporting stone fractions. For some embodiments, the stone fractions are positioned on the pallets so that they may be removed in an order of usage to make the wall. Another stone wall kit embodiment is illustrated at 32 in FIG. 9.

For some embodiments, the stone fractions are numbered and labeled with RFID tags. The RFID tags include additional information that permits close tracking of the stone or stone fraction. For other embodiments, the stone or stone fractions are numbered and labeled with bar codes. For other embodiments, the stones or stone fractions are numbered with actual numbers, as shown in FIG. 3. For some embodiments, the numbers are color coded with corresponding colors in the image, as is shown in FIG. 4.

For some embodiments, an image of a stone wall 40 to be made is included in the stone wall kit. The wall embodiment made using the image 40 includes stones forming a five inch base course 21. Stones used in the base course 21 are labeled as "B" to designate their position as base course stones and a number, such as B-1, B-2, and so forth, to designate each stone's position in the base of the stone wall. Kits described herein may optionally include a compacted base component 19. Another portion of the stone wall image 40 is the lift system wherein larger jumper stones, each the maximum height of that particular lift, are placed in strategic areas which create a segment of the Ashlar pattern. Another portion of the stone wall image 40 is an eight inch lift, shown as 23 in FIG. 4. Stones for this lift have tags that are color coded. The eight inch lift 23 includes one to three layers of stone equaling the height of the eight inch jumper stone, designated by the "1", "2" and "3" prefix, respectively. The stone designated "1-1" indicates that the stone is to be positioned as the first stone in the first eight inch lift layer. Another portion of the stone wall image 40 is the 7.5 inch lift 27. Stones for this 7.5 inch lift are in one to three layers and include 7.5 inch jumper stones and have tags that are color coded and have a color different from tags for the eight inch lift. Another portion of the wall image is a 7 inch lift 29. Stones in the 7 inch lift are marked with tags having a color different from the other lifts or the base. The 7 inch lift includes one to three stone layers and includes 7 inch jumper stones. Similarly, the 6.5 inch lift and the 6 inch lift 33 also include stones tagged with colors defined for that particular lift. Stone tags also include location in terms of the particular layer and the position within the layer. For some embodiments, the lifts 23, 27, and 29, are standard lifts that are used to construct walls of varying size.

The tagged stones are arranged for transport and usage on pallets in an order that enables users to remove the stones in the order that they are required to construct the wall. For instance, stones used in the base layers are positioned at the top of a pallet of stones. Also, the tagged stones may be packaged for either left-to-right installation or right-to-left installation. Images are also provided for left-to-right or right-to-left installation.

The stone wall kit embodiments described herein reduce stone wastage because the stones are presorted. The stone wall kit embodiments also reduce labor requirements for wall installation by more than fifty percent over conventional stone wall constructions.

Figure 1A:
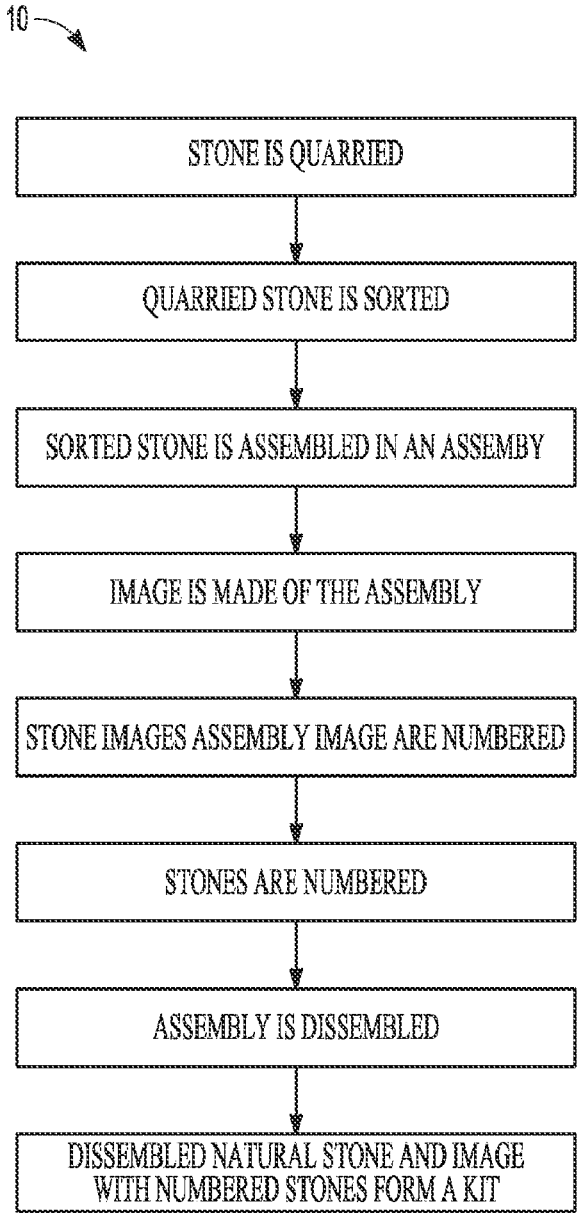
FIG. 1A illustrates a schematic view of a method embodiment for making a stone wall.
Figure 2:
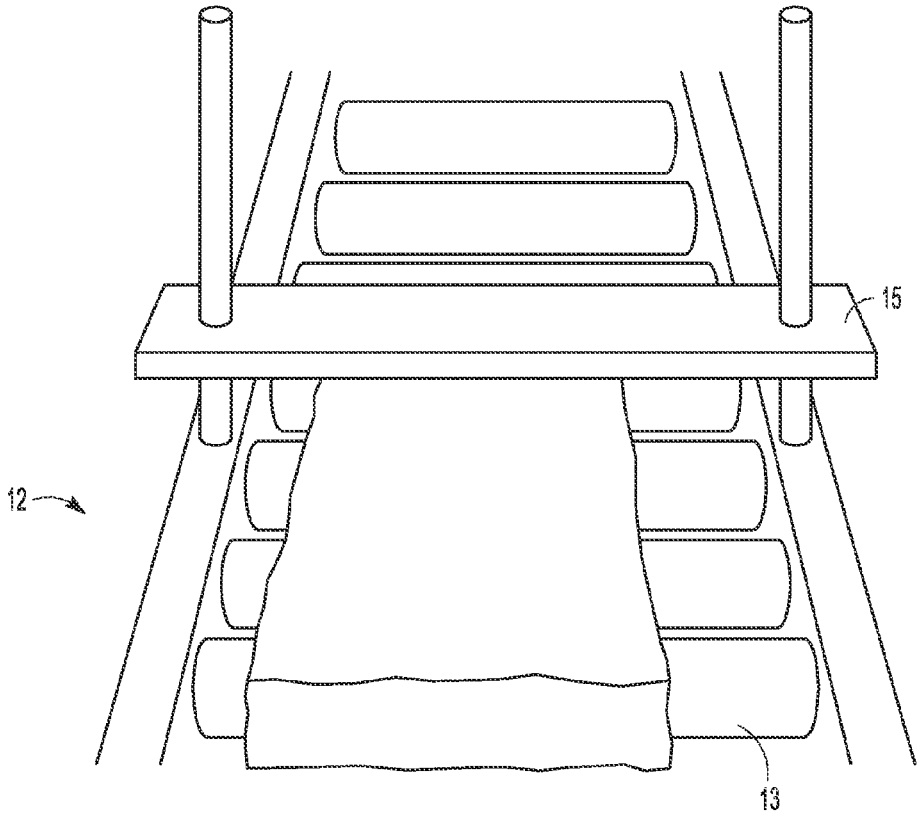
FIGS. 2 and 7 illustrate a perspective view of a sorter used to make some stone wall embodiments.
Figure 7:
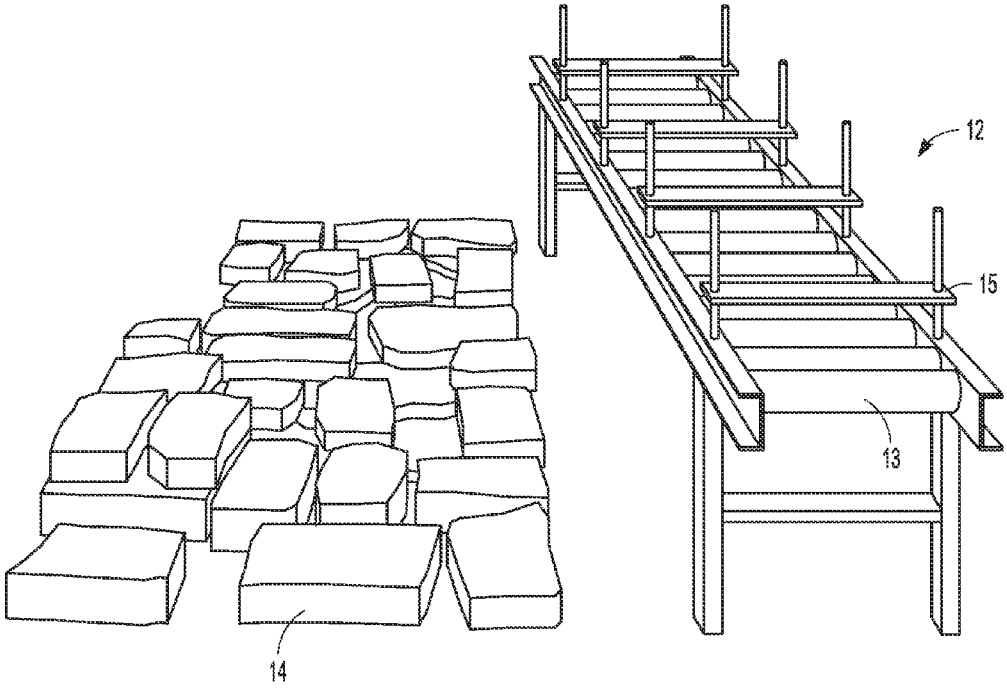
Figure 8:
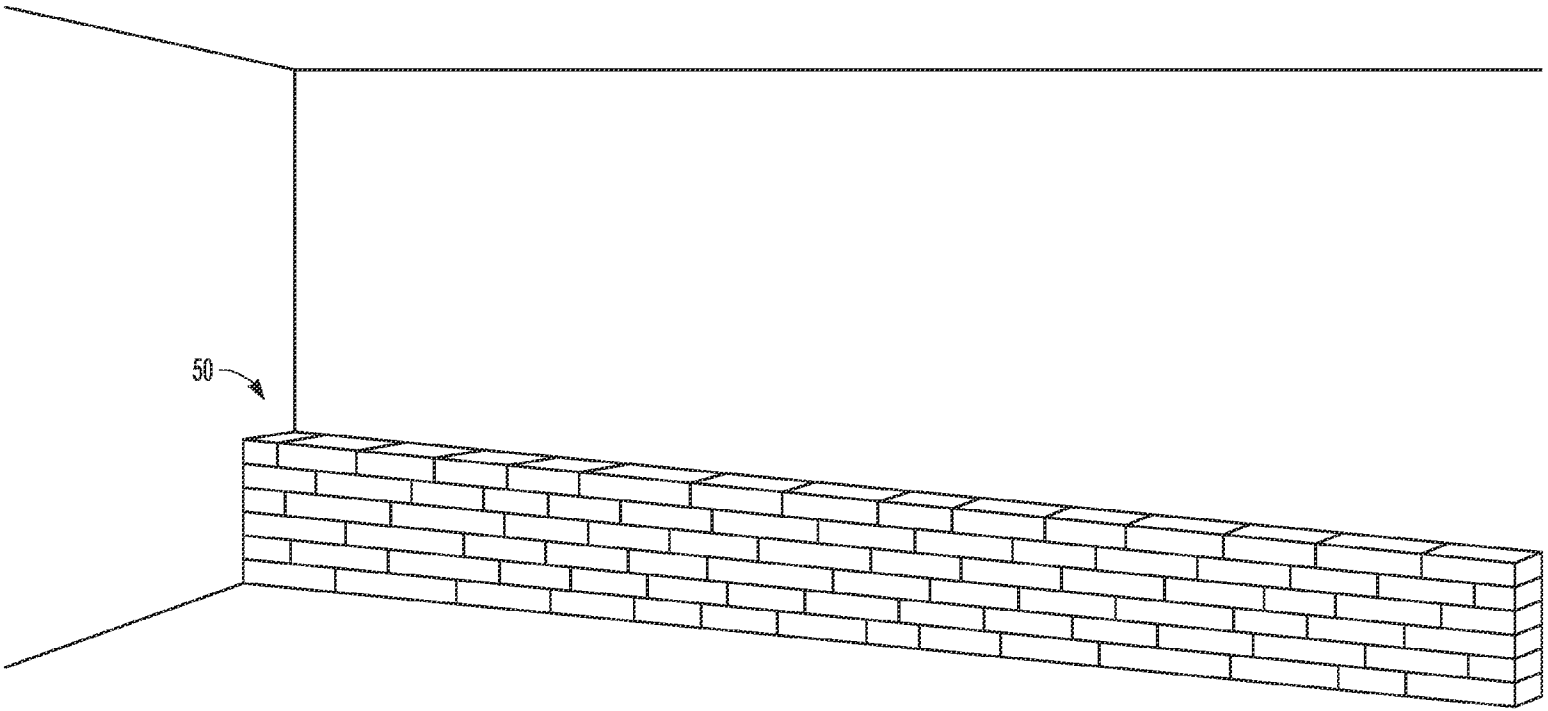
FIG. 8 illustrates a wall made using the image of FIG. 6.

In one method embodiment for manufacturing a stone wall using a kit embodiment described herein, illustrated schematically at 10 in FIG. 1A, stones are used to make a wall such as is shown at 50 in FIG. 8. The method includes obtaining stones or stone fractions or both from a quarry, or from a supplier of quarried stones, and sorting the stones on a basis of thickness and length to prepare a sorted plurality of stones. The stones are sorted using a sorter 12 such as is shown in FIGS. 2 and 7. For some embodiments, the stones are sorted in a plurality of sorters 12. One sorted plurality of stones is shown at 14 in FIG. 7.

Sorting is performed, for some embodiments, using one or more sorting tables, as shown for one sorter embodiment, at 12 in FIG. 2 that sort stone fractions by thickness and by length. The sorting table includes rollers 13 for conveying stones and a sorting block 15 for sorting stones by thickness. The sorting block 15 is positioned at a distance above the rollers to impede movement of a stone having a thickness too great to pass beneath the block 15. While a block 15 is shown, it is understood that sorter embodiments may include a laser beam for calibrating height and length of acceptable stones.

Figure 9:
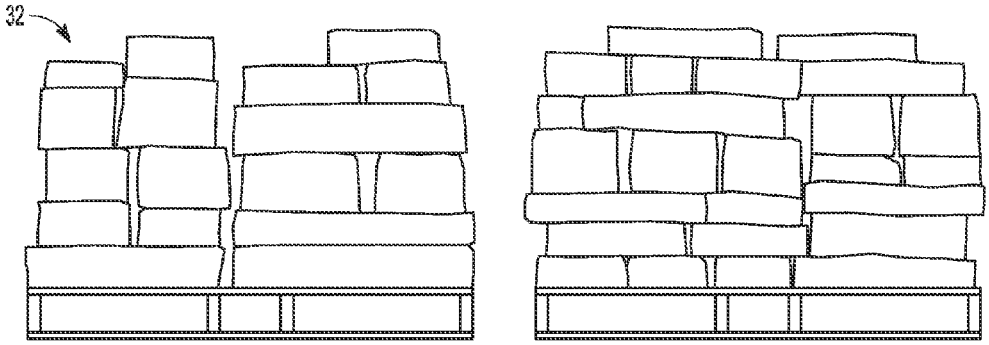
FIG. 9 illustrates sorted stones and pallets of a stone wall kit.

For this method embodiment, the wall is then disassembled and numbered stone fractions are arranged for transport on a structure, such as a pallet, as shown for the kit at 32 in FIG. 9.

The kit 32 that includes pallet 37 with the numbered stone fractions and wall image with numbered stones is shipped for sale or to end users.

In one kit embodiment for making a stone wall, a software program is used to quantify the number of stones having a pre-selected thickness required for a particular type of wall. Some software program embodiments also quantify the number of stone fractions having a pre-selected length. Some programs quantify the number of stone fractions having a pre-selected shape. These software programs are usable to create a stone wall without actually having to assemble and disassemble the wall, as is shown schematically at 8 in FIG. 1B.

Figure 5:
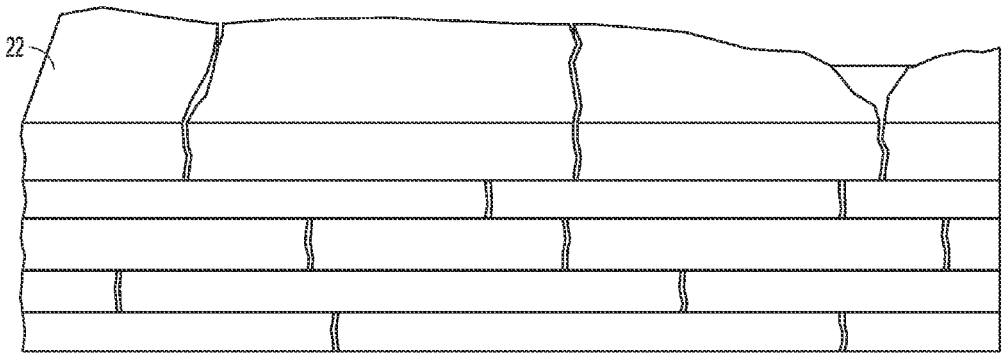
FIG. 5 illustrates a wall assembled using the image of FIG. 4.
Figure 6:
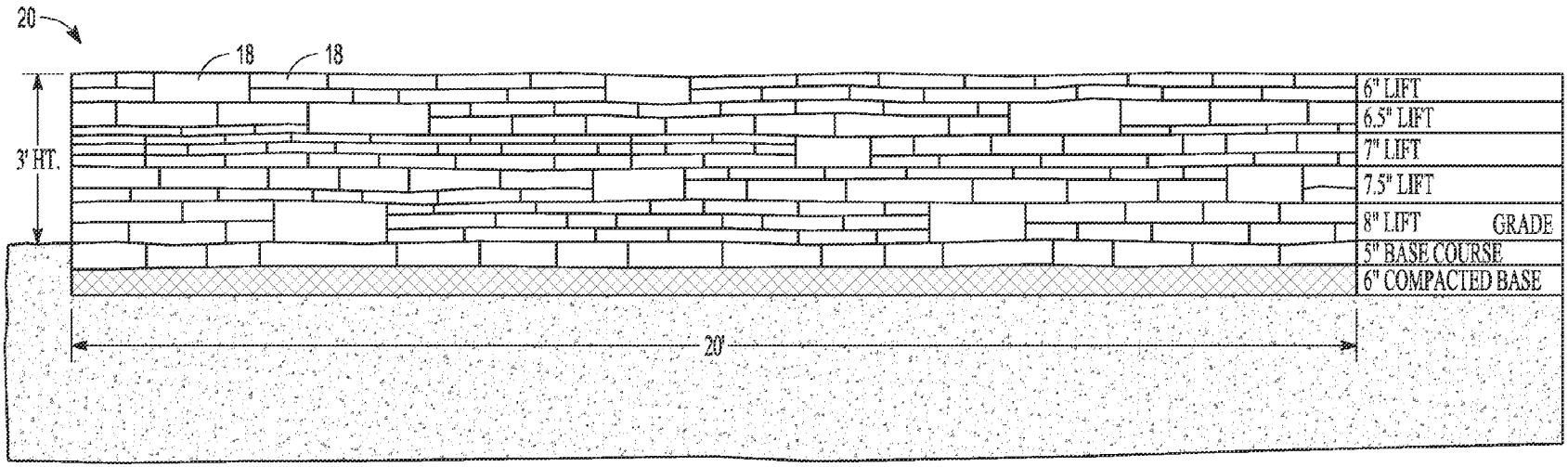

In one embodiment, the sorted plurality of stones or stone fractions or both 14 are assembled to make the stone wall 50, such as is shown in FIG. 8. An image of the wall, shown at 20 in FIG. 6 is prepared and the images of the stones 18 are numbered, as shown in FIG. 4. The actual stones or stone fractions or both 22 are also numbered, as shown in FIG. 5 to correspond to numbered stone fractions or stones or both 18 in the image of the wall 40, shown in FIG. 4.

Figure 1B:
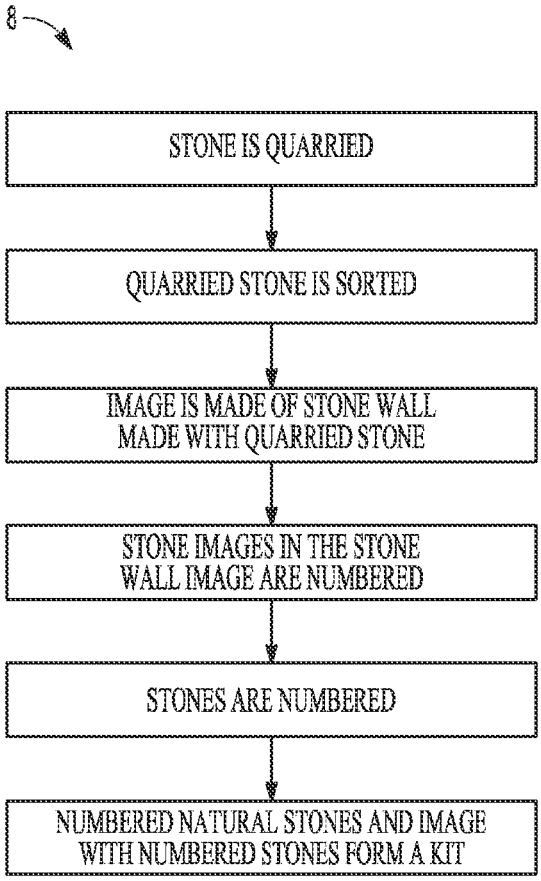
FIG. 1B illustrates a schematic view of another method embodiment for making a stone wall.

In another method embodiment shown at 8 in FIG. 1B, stones are labeled based upon their thickness and length to designate their position in a wall. In this embodiment, there is no pre-assembling or disassembling of the wall.

For embodiments where the wall is pre-assembled, the wall is then disassembled and numbered stone fractions are arranged for transport on a structure, such as a pallet 37, as shown for the kit at 32 in FIG. 9. The pallet 37 with the numbered stone fractions and wall image with numbered stones are shipped for sale or to end users. A kit that includes a pallet 37 is also prepared for an embodiment where stones are not pre-assembled.

The wall is constructed by placing pallets 37 containing the stones near the site of wall installation. The stones are removed from the pallet in an order of installation so that, for instance, the top stones on the pallet form the wall foundation. Stones may be removed to make the wall from either left-to-right or right-to-left from pallets having stones pre-ordered left-to-right or right-to-left. One wall made with a stone wall kit had a length of about twenty feet. It is understood that kits may be made for making walls having greater or lesser lengths.

Method embodiments described herein decrease time required for making stone walls by more than 50%, for most embodiments. Additionally, the method embodiments permit the creation of designs that further enhance the aesthetics of an area.

Figure 11:
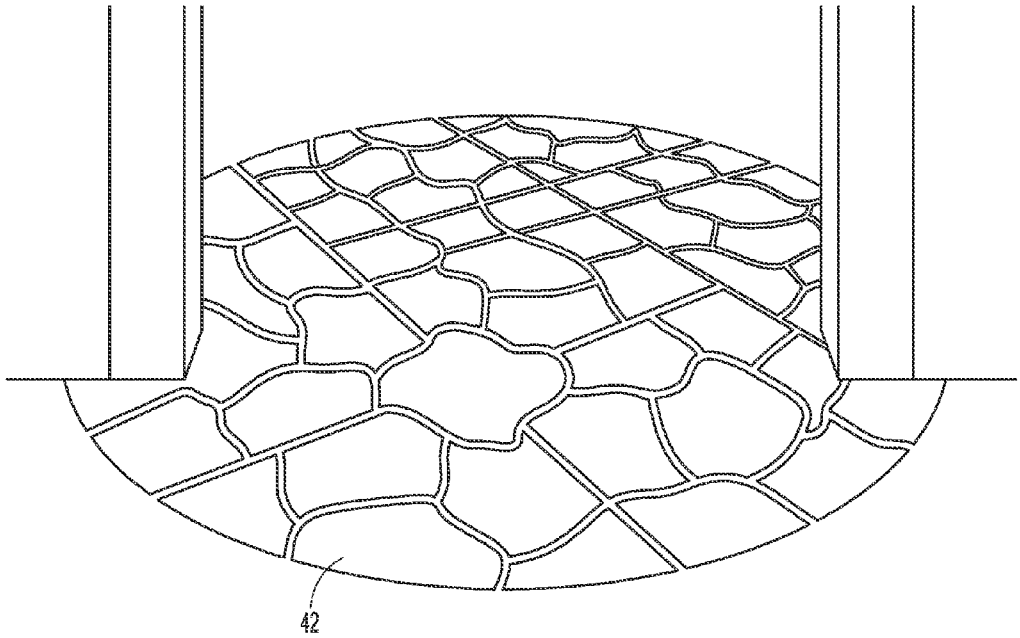
FIG. 11 illustrates a top plan view of a stone patio embodiment of the invention.
Figure 15:
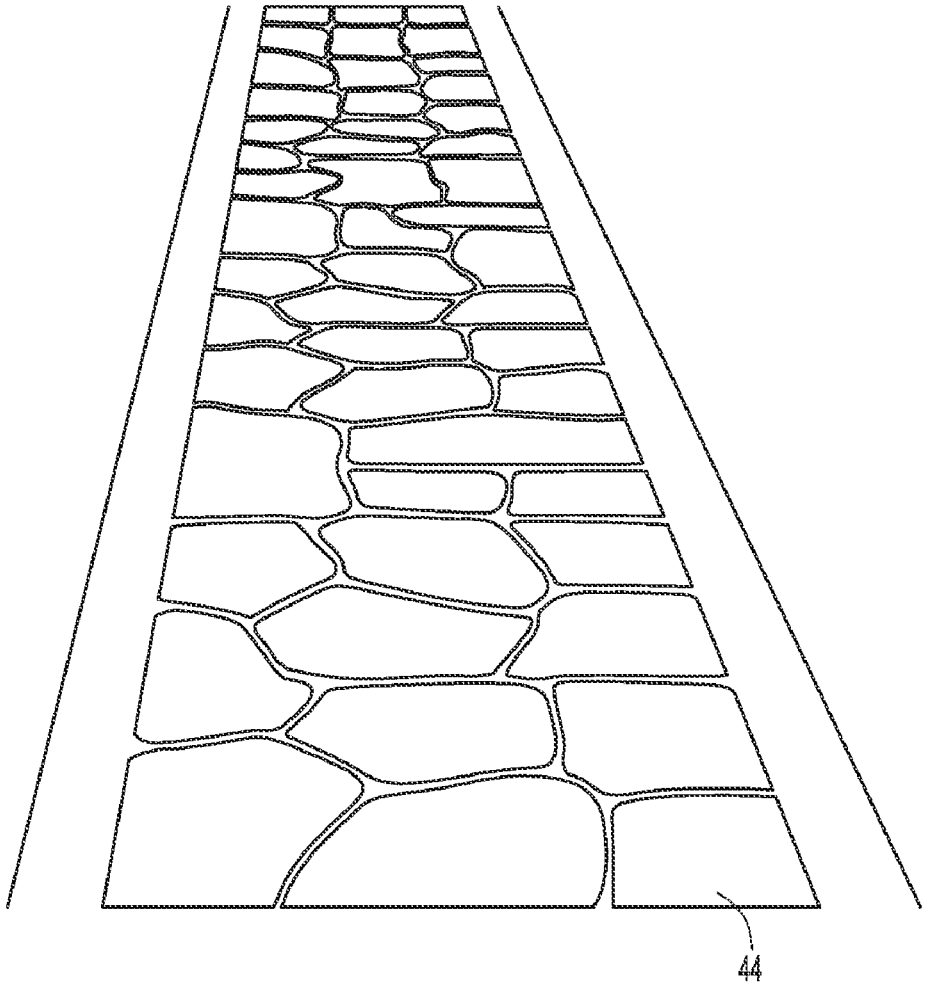
FIG. 15 illustrates a walkway embodiment of the invention described herein.
Figure 17:
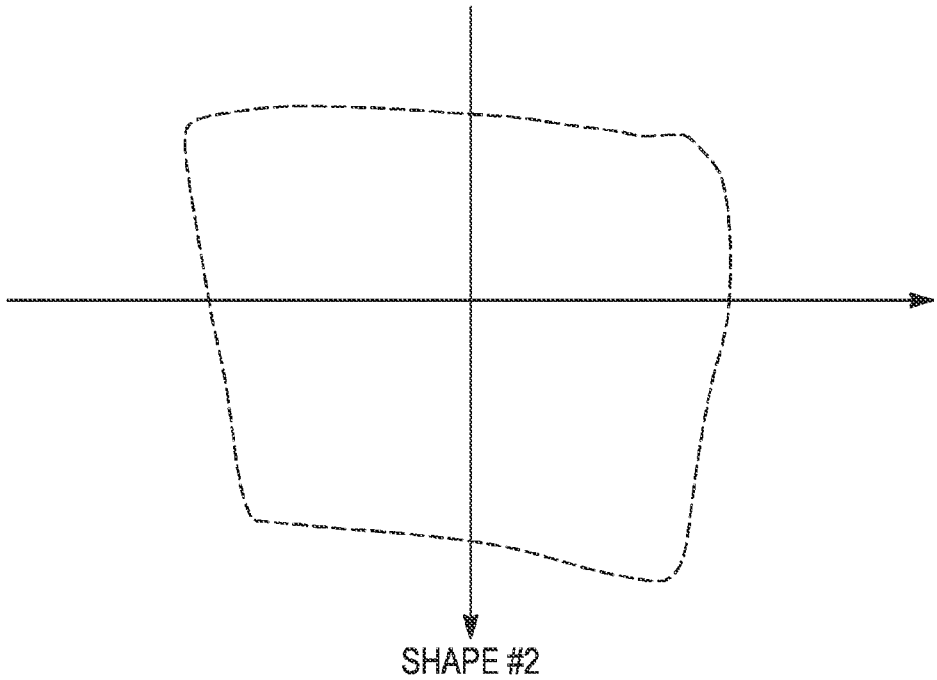
FIGS. 17-25 illustrate standard stone shape embodiments for use in making stone patios and walkways. These standard shapes are designated on the figures with numerals ranging from 1 to 13.
Figure 18:
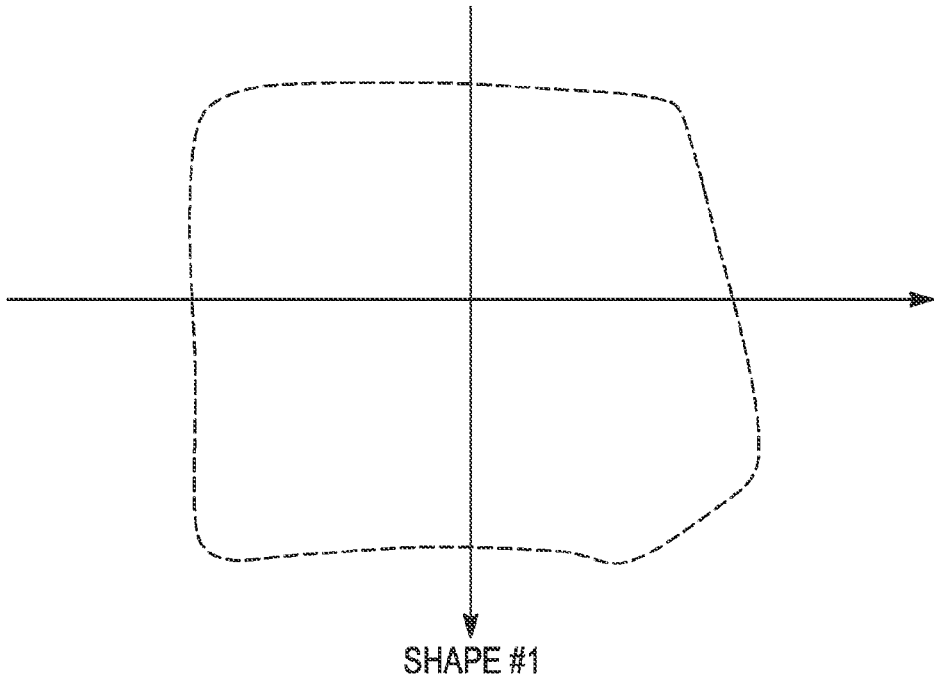
Figure 19:
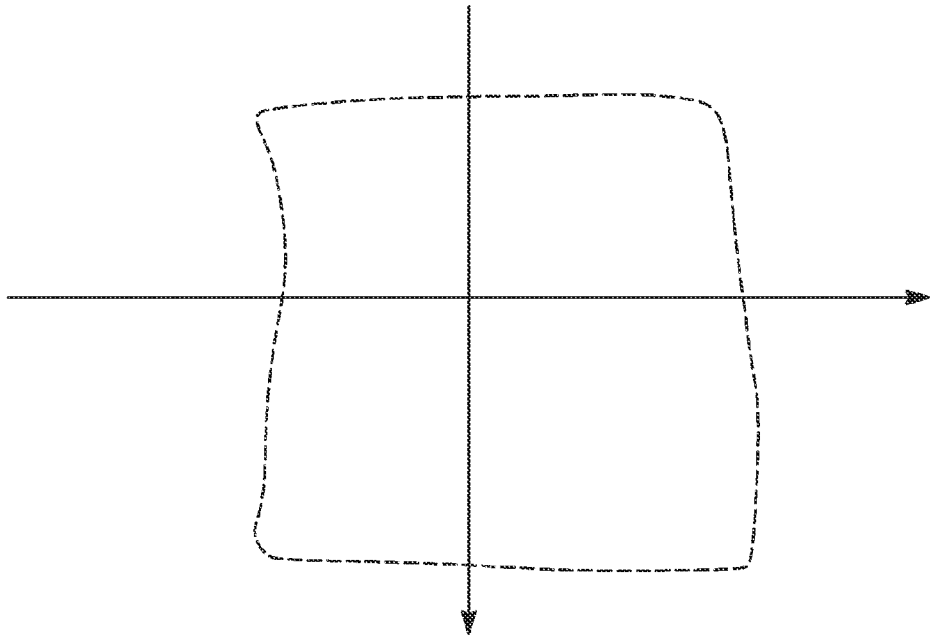
Figure 20:
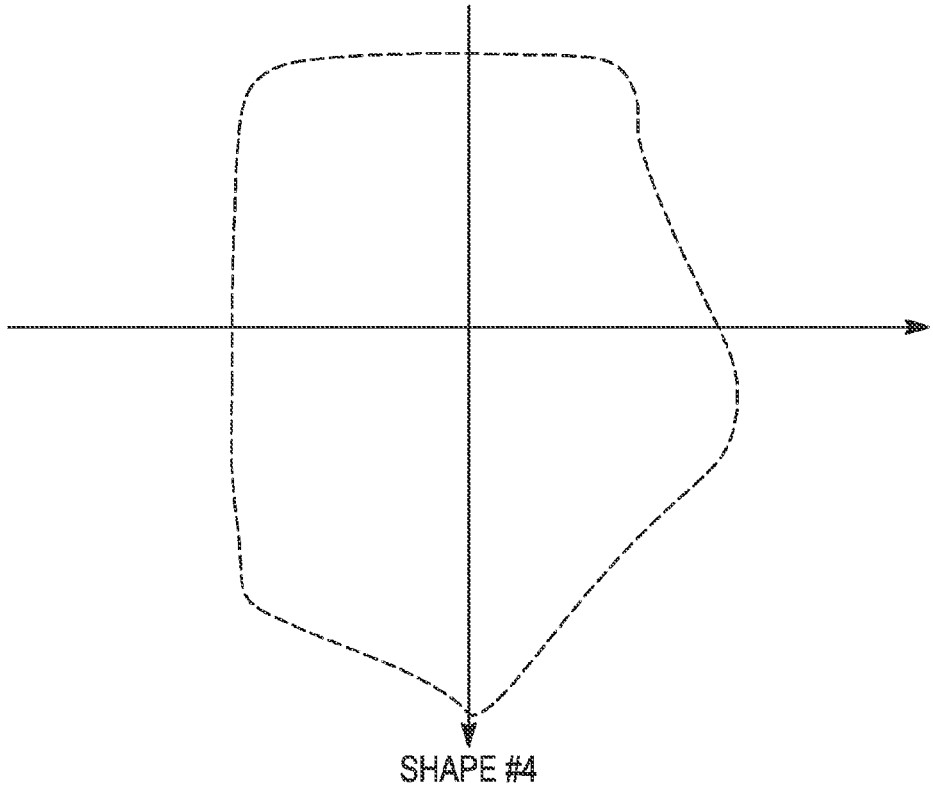
Figure 21:
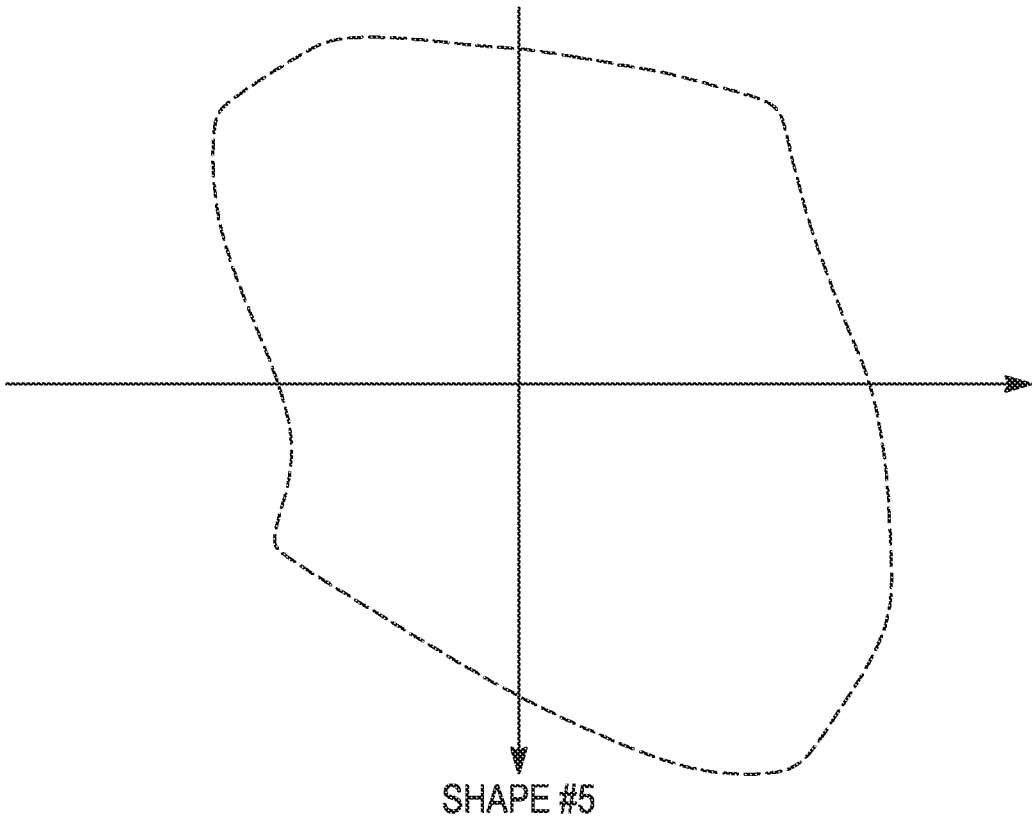
Figure 22:
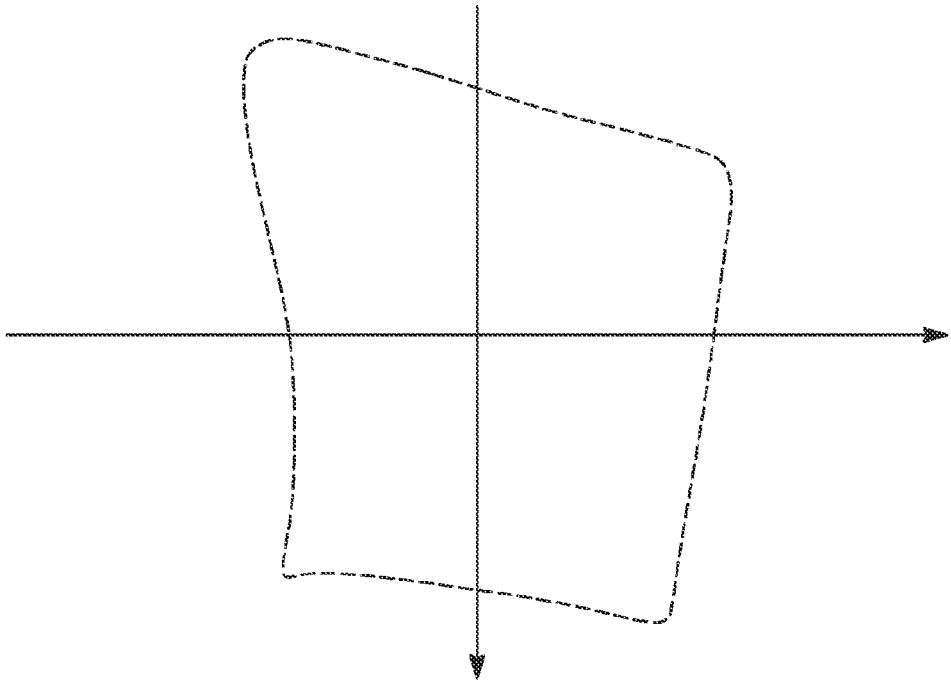
Figure 23:
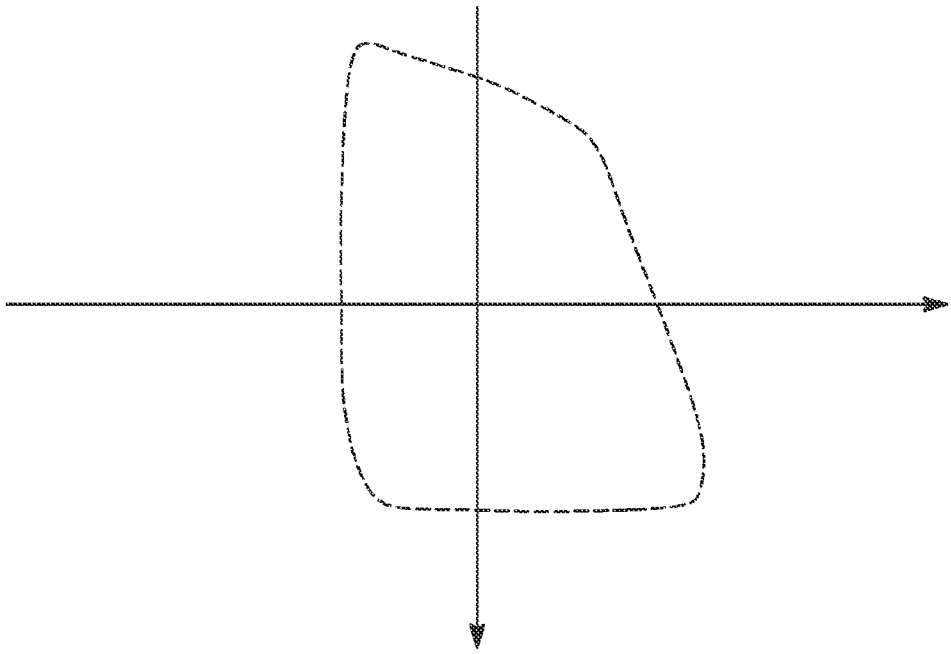
Figure 24:
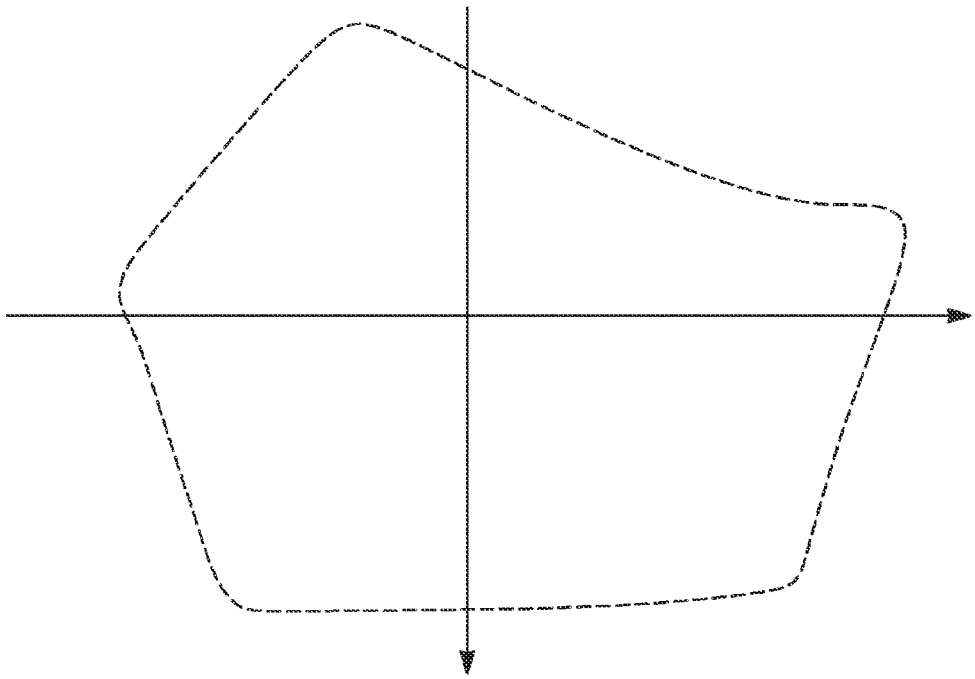
Figure 25:
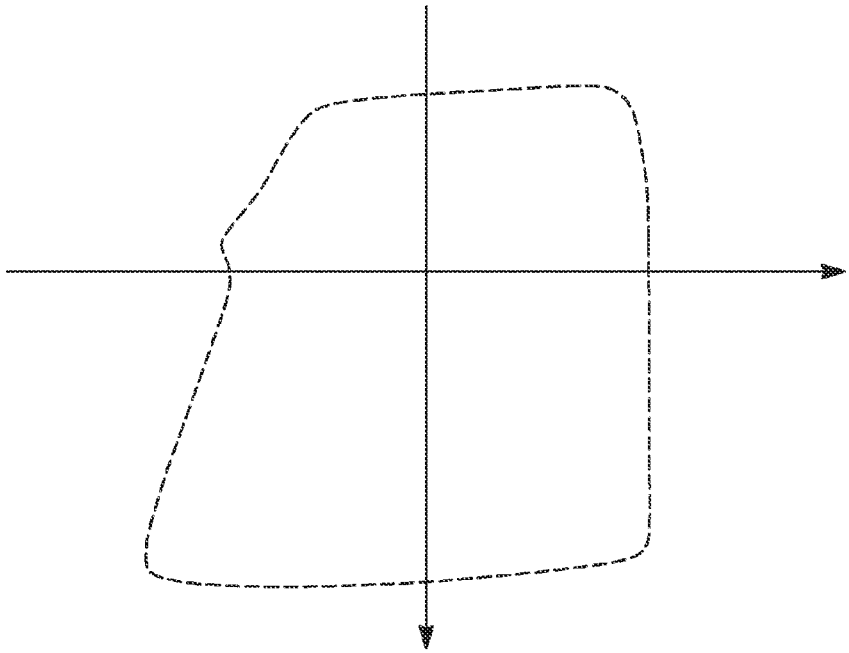
Figure 26:
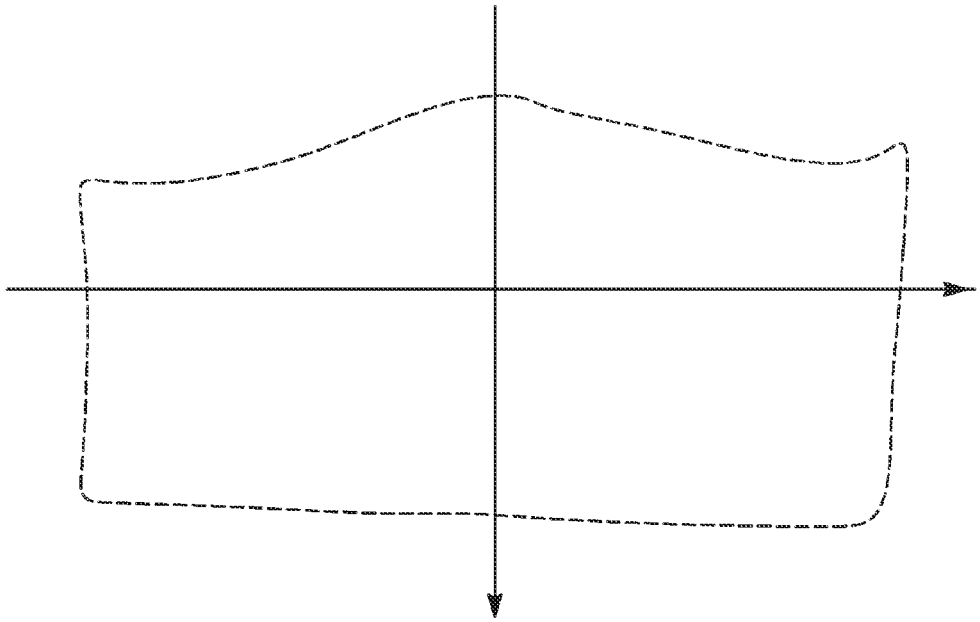
FIG. 26 illustrates a super-shape made by placing a stone having shape No. 3 adjacent to a stone having shape No. 6. This super-shape has a designation of shape 10.
Figure 27:
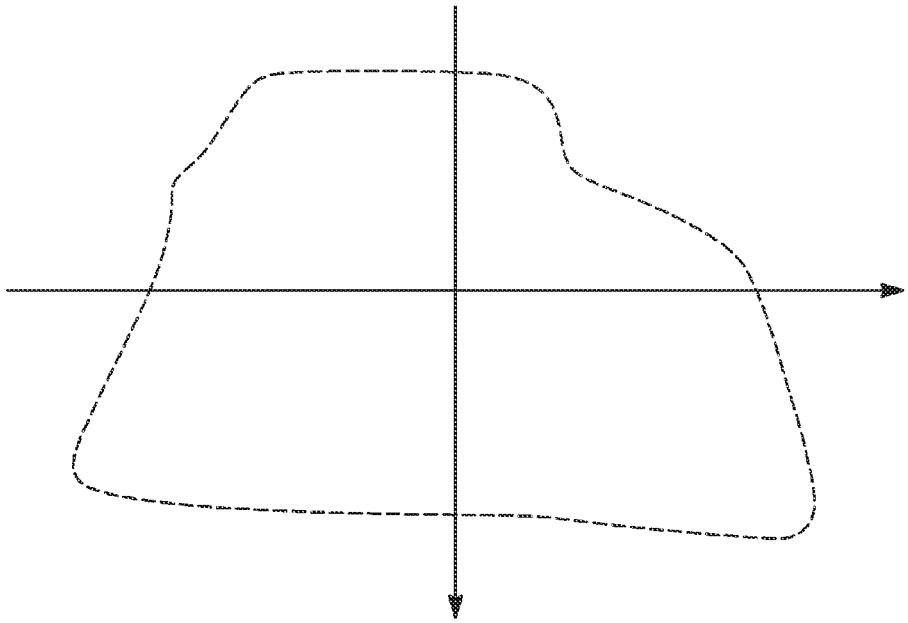
FIG. 27 illustrates a super-shape made by placing a stone having shape No. 9 adjacent to a stone having shape No. 7. This super-shape has a designation of shape 11.
Figure 28:
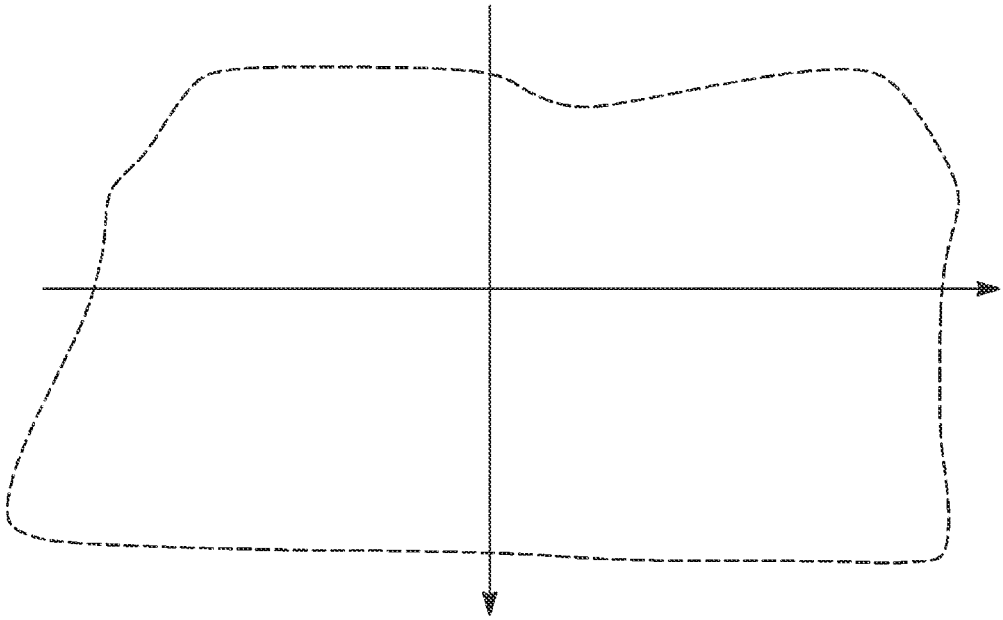
FIG. 28 illustrates a super-shape made by placing a stone having shape No. 1 adjacent to a stone having shape No. 9. This super-shape has a designation of shape 12.
Figure 29:
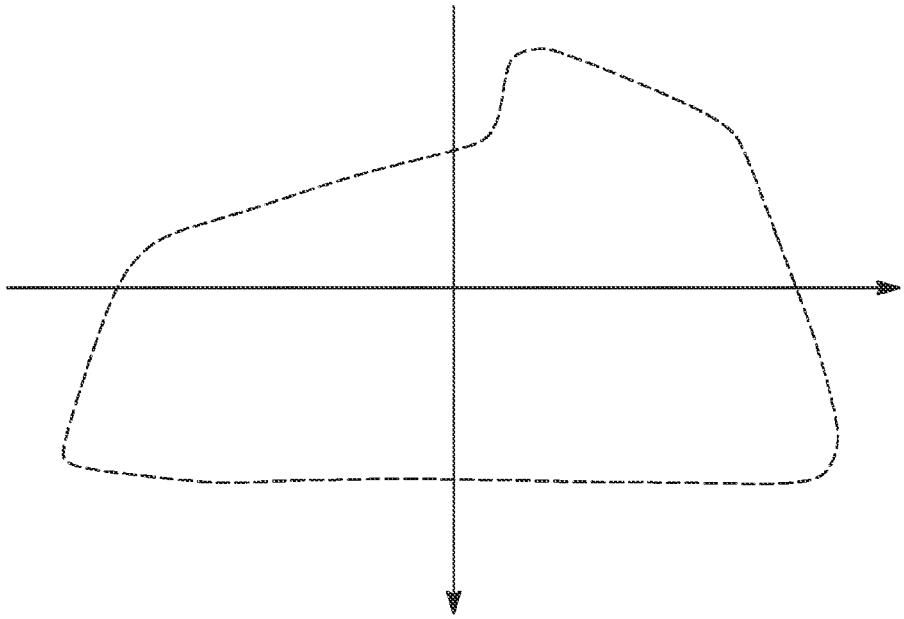
FIG. 29 illustrates a super-shape made by placing a stone having shape No. 7 adjacent to a second stone having shape No. 7. The super-shape designation is shape 13.

Another embodiment of the invention includes a kit, referred to herein as a stone walkway/patio/flooring kit for making a stone walkway, stone patio, or other type of stone flooring, such as is shown for a patio embodiment shown at 42 in FIG. 11 and for a walkway at 44 in FIG. 15. The stone walkway/patio/flooring kit includes shaped stones wherein each stone has, for some embodiments, one of fourteen shapes. The shapes are scalable, keeping the relative proportions to each other, both for bigger stones and for smaller stones. One of the shapes is illustrated in FIG. 17. Other shapes and their corresponding shape number are shown in FIGS. 17 to 25. Super-shapes may be made from the standard stone shapes shown in FIG. 17-25. The super-shapes are shown in FIGS. 26-31. FIG. 26 shows a super-shape designated as shape 10, which is made by positioning a stone having shape no. 6 adjacent to a stone having shape no. 3. FIG. 27 shows a stone super-shape no. 11 that is made by positioning a stone having shape no. 9 adjacent to a stone having shape no. 7. FIG. 28 shows a stone super-shape no. 12 that is made by positioning a stone having shape 9 adjacent to a stone having shape no. 1. FIG. 29 shows a stone super-shape no. 13 made by positioning two stones having shape no. 7 adjacent to each other. FIGS. 30 and 31 show a stone super-shape 14 that is made by postioning four stones having shape no. 7 adjacent to each other or by postioning two super-shape no. 13 stone arrangements adjacent to each other. The super-shape 14 may also be made by positioning two stones having shape 7 and one super-shape stone arrangement 13 adjacent to each other.

Figure 13:
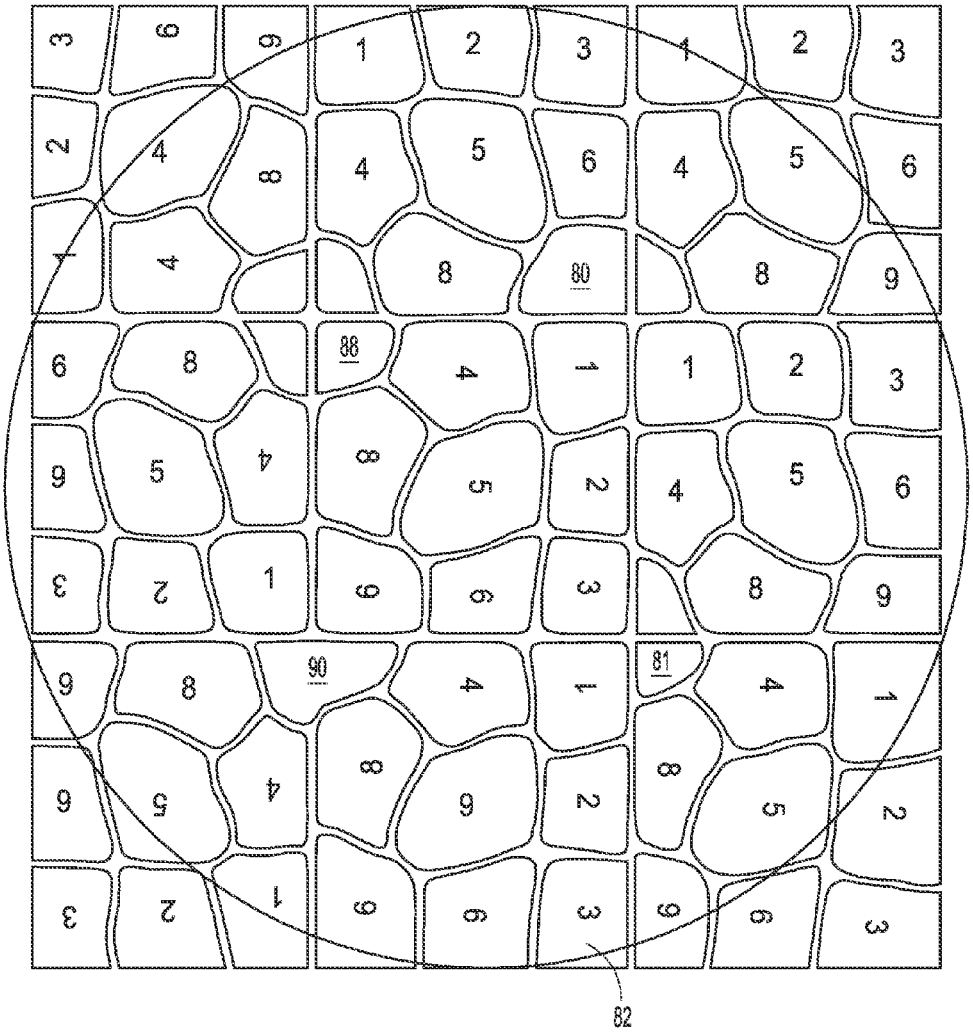
FIG. 13 illustrates an image of a stone patio embodiment illustrating "super shapes" comprising groups of stones, each having a standard shape.
Figure 14:
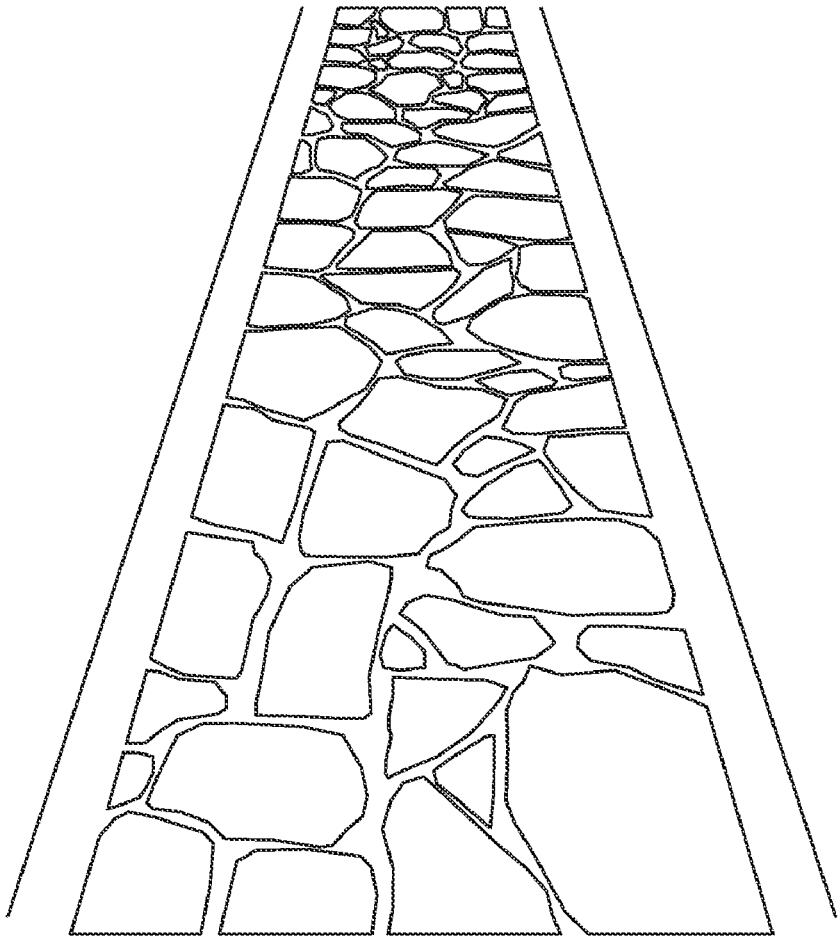
FIG. 14 (PRIOR ART)
FIG. 14 illustrates a prior art walkway embodiment.
Figure 16:
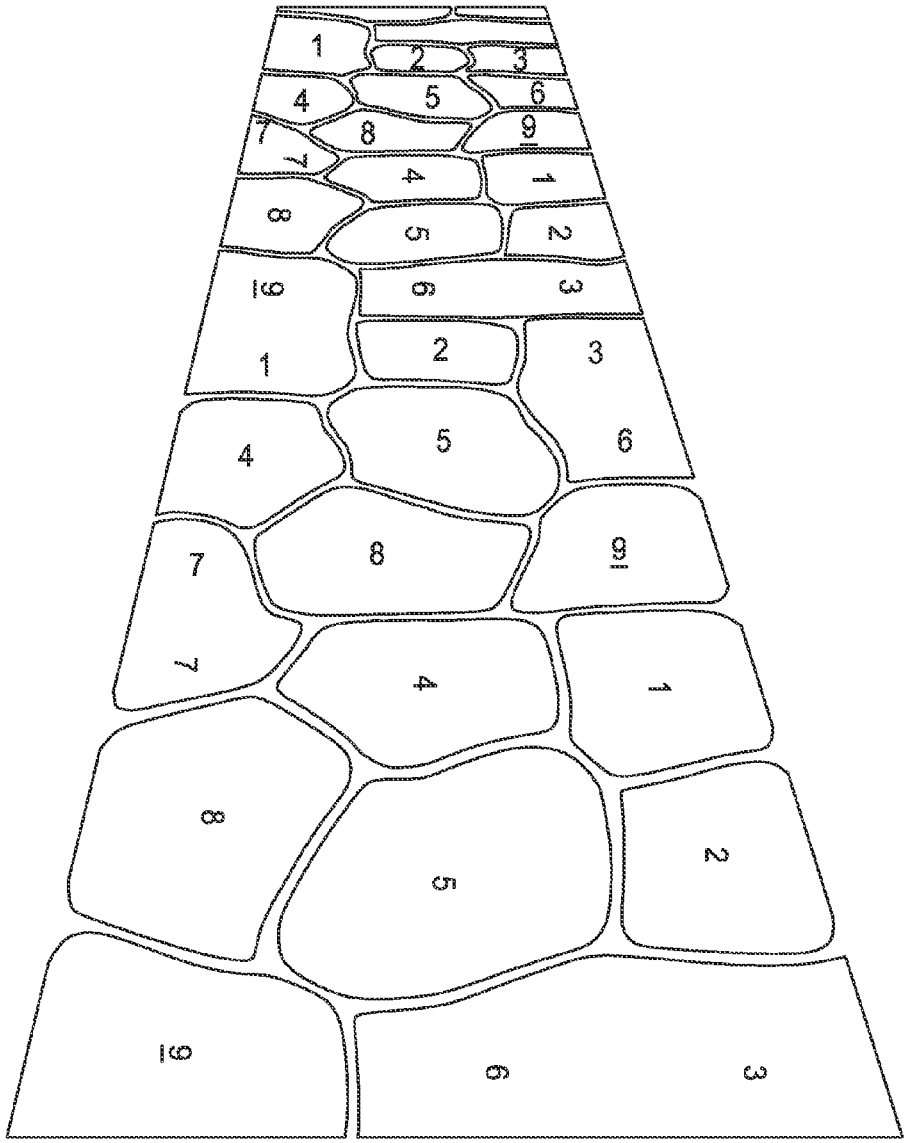
FIG. 16 illustrates an image of the stone walkway embodiment of FIG. 14, wherein the stone images are numbered.

These stone shapes, in a stone patio are illustrated in FIG. 13. The shapes, in a stone walkway are illustrated in FIG. 16.

For some embodiments, particularly embodiments for making a stone walkway, patio, or floor, one or more of the stone fractions are cut at the time of sorting. For some embodiments, particularly embodiments for making a stone patio, walkway, or floor, the stone fractions are shaped to form one of the shapes shown in FIGS. 17-25 at the time of sorting.

Figure 12:
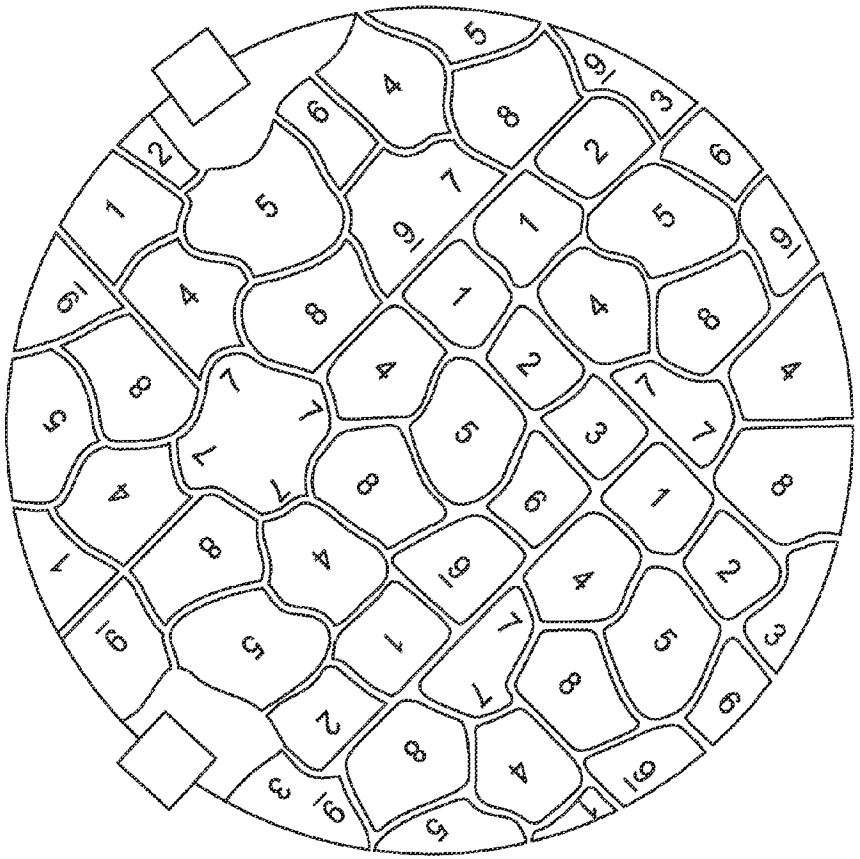
FIG. 12 illustrates an image of the stone patio embodiment of FIG. 11, wherein the stone images are numbered.

The individual stone shapes are, in some instances, combinable to make super-shapes, such as is shown at 82, 84, 86, 88 and 90 in FIG. 13, as well as in FIGS. 26-31. For one embodiment, when a stone having shape identified as number "9" in FIG. 13 is placed adjacent to a stone having shape designated as number "3" a supershape is formed. Other combinations to make supershapes are shown in FIG. 12. For instance, four stones identified as "7" form a supershape. The fourteen stone shapes and super-shapes are usable to make a wide variety of stone walkways, patios, or floors.

For some embodiments, the stone walkway/patio/flooring kit further includes computer readable media, software, that is used for making particular walkway, patio, or flooring configurations using the fourteen stone shapes and super-shapes. While fourteen shapes for stones are described herein, it is understood that additional shapes and super-shapes may be suitable for use.

The kit also includes an image of the walkway, patio, or floor such as is shown in FIGS. 16 and 12. The walkway, patio, or floor is constructed using the image that includes images of the shaped stones and an identification of each of the stones. For some embodiments, the identification of each of the stones is based upon its shape.

For the stone walkway, patio, and flooring embodiments, stone fraction shapes are standardized within a plurality of fourteen shapes and supershapes, in one embodiment, to form a grid. Each stone or super shape may be turned a different direction with respect to an x-y axis, with one or more of the supershapes replacing grid stones to form standardized a plurality of stone walkway, patio, or flooring types.

By standardizing the stone shapes to a particular number, stone walkways, patios, and floors made with the stones have uniform clearance between the stones and have pleasing aesthetics. Additionally, the stone walkways, patios, and floors do not generally have small irregular stones in the main grids that are susceptible to being unevenly positioned relative to other stones, thereby being a tripping hazard or being susceptible to removal.

Kit embodiments for making stone walls and stone walkway/patio/floors described herein remove variables in design that result from differences in methodology by individual craftsmen. The stone walkway/patio/flooring kits include stones that are pre-cut, if necessary, pre-sorted, thereby reducing labor costs and training costs. The stone walkway/patio/flooring kits form stone structures that have uniform spacing and gaps. The stone wall and stone walkway/patio/flooring kits enable workmen to install a stone structure without a need for stone cutting, without a need for stone sorting, without a formation of dust and debris, without wastage, and without a need for restocking unusable stone.

Figure 10:
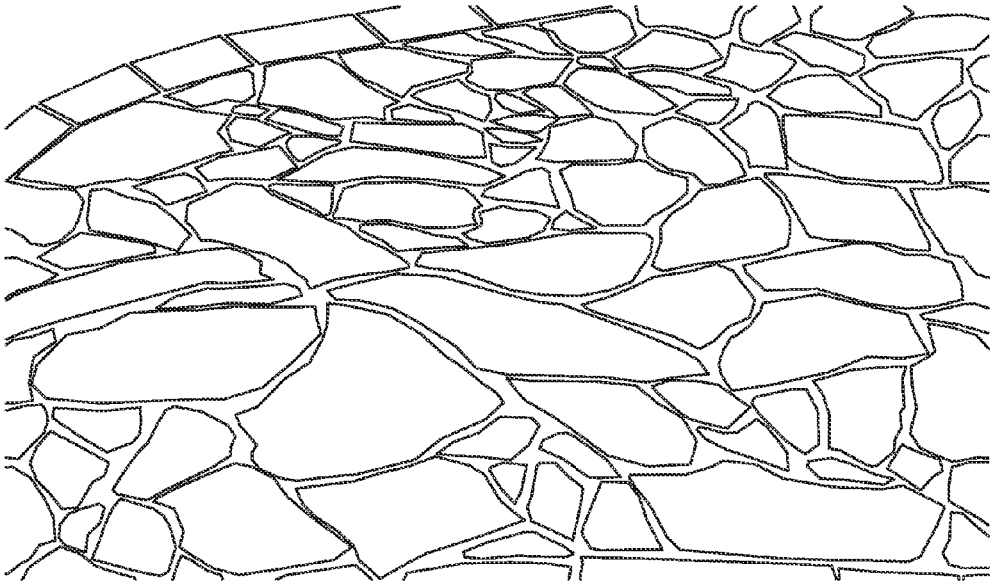
FIG. 10 (PRIOR ART)
FIG. 10 illustrates a top plan view of a prior art stone patio.

An example of a prior art patio system is shown in FIG. 10. A stone walkway/patio/flooring kit embodiment of the invention described herein was used to make a patio shown at 42 in FIG. 11. As can be seen, the patio made from the stone patio kit, shown in FIG. 11, has uniform gaps between stones and is free of small stones except at perimeter where stones are not full size, thus creating the patio shape. The appearance of the patio shown in FIG. 11 may be more aesthetically acceptable than the patio of FIG. 10. A numbered image of the kit used to make the patio shown in FIG. 11 is shown in FIG. 12. Some kit embodiments include programs for making stone walkways, patios, or floors quantify the number of stone fractions having a pre-selected shape.

For method embodiments making a stone walkway, a stone patio, or a stone floor, stone fraction shapes are standardized within a plurality of shapes to make a standardized plurality of stone types. By standardizing and pre-selecting stone thickness and shape, stone walkways, patios, and floors made with the stones have uniform clearance between the stones and have a pleasing aesthetics. Also, the patios and walkways do not require small stone fractions to fill in spaces in the main embodiment.

For some embodiments, the stone fractions are numbered and labeled with RFID tags. The RFID tags include additional information that permits close tracking of the stone or stone fraction. For other embodiments, the stone or stone fractions are numbered and labeled with bar codes. For other embodiments, the stones or stone fractions are numbered with actual numbers, as shown in FIGS. 12 and 16. For some embodiments, the numbers are color coded with corresponding colors in the image, as is shown in FIG. 4.

Method embodiments described herein decrease time required for making stone walls by at least fifty percent. In some embodiments, the time reduction is from sixteen man hours, required for constructing conventional prior art stone walls, to not more than seven man hours, for some embodiments. Additionally, the method embodiments permit the creation of designs that further enhance the aesthetics of an area.

Kit embodiments described herein remove variables in design that result from differences in methodology by individual craftsmen. The kits include stones that are pre-cut, if necessary, and pre-sorted, thereby reducing labor costs and training costs. The walkway/patio/flooring kits form stone walkways, patios, and floors that have uniform spacing and gaps. The stone wall kits and walkway/patio/flooring kits enable workmen to install a stone structure without a need for stone cutting, without the need for stone sorting, without a formation of dust and debris, without wastage, and without a need for restocking unusable stone.

Having described and illustrated the principles of the invention in particular embodiments thereof, it should be apparent that the invention can be modified in arrangement and detail without departing from such principles. The scope of the invention is intended to be limited only by the claims appended hereto.

What is claimed is:

1. A method for making a stone wall manufacturing kit, comprising:

providing a plurality of stones having a variety of thicknesses and lengths;

sorting the stones based upon length and thickness of each of the stones;

assembling a stone wall from the plurality of stones;

preparing an image of the stone wall;

marking each stone within the image based on each stone's location and orientation in the assembled stone wall with an identifier to make a marked stone image, wherein the stone wall is assembled before marking each stone within the image;

marking each stone of the plurality of stones with an identifier corresponding to the identifier of the stone in the image of the assembled stone wall based on each stone's location and orientation in the assembled stone wall, wherein the stone wall is assembled before marking the stones; and packaging the marked stones and marked stone image to make a stone wall kit, wherein the stone wall is disassembled prior to packaging the marked stones, and wherein the plurality of stones are arranged in the stone wall kit in an order which is required to construct the stone wall so that top stones on the stone wall kit are used to form a foundation of the stone wall under construction.

2. The method of claim 1, wherein each of the stones are marked with an RFID tag.

3. The method of claim 1, wherein each of the stones are marked with a bar code.

4. The method of claim 1, wherein each stone wall kit includes stones and an image to make a unique stone wall.

5. The method of claim 1, wherein each stone wall kit includes stones and an image to make one of an array of standard stone walls.

6. A stone wall made by the method of claim 1.

* * * * *